US010854417B1

(12) United States Patent
Lewellen et al.

(10) Patent No.: US 10,854,417 B1
(45) Date of Patent: Dec. 1, 2020

(54) RADIAL RADIO FREQUENCY (RF) ELECTRON GUNS

(71) Applicant: Triad National Security, LLC, Los Alamos, NM (US)

(72) Inventors: John Lewellen, Los Alamos, NM (US); John Harris, Albuquerque, NM (US)

(73) Assignee: Triad National Security, LLC, Los Alamos, NM (US)

( * ) Notice: Subject to any disclaimer, the term of this patent is extended or adjusted under 35 U.S.C. 154(b) by 0 days.

(21) Appl. No.: 16/171,458

(22) Filed: Oct. 26, 2018

Related U.S. Application Data

(60) Provisional application No. 62/577,561, filed on Oct. 26, 2017.

(51) Int. Cl.
*H01J 31/06* (2006.01)
*H01J 29/48* (2006.01)
*H01J 29/04* (2006.01)

(52) U.S. Cl.
CPC ..... *H01J 31/06* (2013.01); *H01J 29/04* (2013.01); *H01J 29/481* (2013.01); *H01J 29/485* (2013.01)

(58) Field of Classification Search
None
See application file for complete search history.

(56) References Cited

U.S. PATENT DOCUMENTS 3,935,503 A * 1/1976 Ress ..... H01F 7/202 315/111.61
4,748,377 A * 5/1988 King ..... H01J 23/005 313/22
5,469,022 A * 11/1995 Begum ..... H01J 23/20 315/39
5,525,864 A * 6/1996 Butler ..... H01J 23/24 315/3.6
5,552,675 A * 9/1996 Lemelson ..... C23C 14/30 219/121.12
6,094,010 A * 7/2000 Washio ..... H01J 23/065 313/36
6,313,710 B1 * 11/2001 Chen ..... H01J 23/20 315/5.44
6,417,622 B2 * 7/2002 Theiss ..... H01J 23/22 315/3.5
6,768,265 B1 * 7/2004 Ives ..... H01J 23/065 315/5.16
7,504,039 B2 * 3/2009 Sadwick ..... G03F 7/2022 216/48

(Continued)

*Primary Examiner* — Crystal L Hammond

(74) *Attorney, Agent, or Firm* — LeonardPatel PC; Michael Aristo Leonard, II; Sheetal Suresh Patel

(57) ABSTRACT

Radial radio frequency (RF) electron guns and radial RF electron gun systems are provided that are capable of generating an electron beam that can propagate either radially inward, towards the axis of a cylinder, or radially outward from the axis. A beam source capable of generating a radially inwardly propagating electron beam, while perhaps not particularly useful as a source for a higher-energy accelerator, offers potential advantages for materials processing, as the geometry allows irradiation from all sides of an enclosed material flow with a single structure. Other potential applications include, but are not limited to, atmospheric plasma generation, radiation damage testing, and possibly, novel electron lens-type devices for hadron accelerators.

19 Claims, 16 Drawing Sheets

(56) References Cited

U.S. PATENT DOCUMENTS

| | | | | |
|---|---|---|---|---|
| 7,550,909 | B2 * | 6/2009 | True | H01J 23/06 313/440 |
| 7,846,391 | B2 * | 12/2010 | Jaffe | G01J 3/10 422/50 |
| 8,232,749 | B1 * | 7/2012 | Barov | H05H 9/044 315/5.41 |
| 9,741,521 | B1 * | 8/2017 | Perkins | H01J 23/11 |
| 10,395,880 | B2 * | 8/2019 | Ferrari | H01J 23/06 |
| 2009/0284126 | A1 * | 11/2009 | Protz | H01J 25/10 313/495 |
| 2013/0015763 | A1 * | 1/2013 | Scheitrum | H01J 23/38 315/5.41 |
| 2015/0340192 | A1 * | 11/2015 | Kang | G01N 23/046 378/4 |
| 2016/0084707 | A1 * | 3/2016 | Scott | G01J 3/0291 356/326 |
| 2018/0279461 | A1 * | 9/2018 | Agustsson | G21K 1/046 |

* cited by examiner

500

RELATED ART

510

RELATED ART

520

600

RELATED ART

610

800

900

910

RADIAL RADIO FREQUENCY (RF) ELECTRON GUNS

CROSS-REFERENCE TO RELATED APPLICATION

This application claims the benefit of U.S. Provisional Patent Application No. 62/577,561 filed Oct. 26, 2017. The subject matter of this earlier-filed application is hereby incorporated by reference in its entirety.

STATEMENT OF FEDERAL RIGHTS

The United States government has rights in this invention pursuant to Contract No. DE-AC52-06NA25396 between the United States Department of Energy and Los Alamos National Security, LLC for the operation of Los Alamos National Laboratory.

FIELD

The present invention generally relates to electron guns, and more particularly, to radio frequency (RF) electron guns capable of generating an electron beam that can propagate either radially inward, towards the axis of a cylinder, or radially outward from the axis.

BACKGROUND

In June of 2017, the U.S. Department of Energy (DOE) Accelerator Stewardship Program released its "FY2017 Research Opportunities in Accelerator Stewardship", including a call for design studies of four types of high-power electron accelerators for energy and environmental applications. Table 1 below lists the target performance for the "Type 1" and "Type 2" accelerators in this call for design studies.

TABLE 1

TARGET PARAMETERS FOR TYPE 1 AND 2 ACCELERATORS

| Criteria: | Type 1 Demo/Small Scale: | Type 2 Medium Scale Low Energy: |
|---|---|---|
| Electron Beam Energy | 0.5 to 1.5 MeV | 1 to 2 MeV |
| Electron Beam Power (CW) | >0.5 MW | >1 MW |
| Wallplug Efficiency | >50% | >50% |
| Target Capital Cost | <$10/W | <$10/W |
| Target Operating Cost | <$1.0 million per year | <$1.5 million per year |

The Type 1 and 2 accelerators described in the DOE National Laboratory Announcement LAB 17-1779 produce electron beam energies in the range of 0.5 to 2 MeV. Many of the example applications of such sources include sterilization or irradiation of waste streams of various types (e.g., industrial effluent streams, waste water, flue gas etc.). All but the lowest portion of the energy range is out of reach of compact direct current (DC)-based source technology.

Most electron beam sources intended for accelerator applications, whether industrial or scientific, make use of a cylindrically symmetric geometry, with the electrons propagating along the axis of symmetry. This is ideal when generating beams intended to be further accelerated, but can complicate the use of such sources for materials processing, especially waste streams. Accordingly, alternate electron beam source architectures that are more suitable to this and other applications may be beneficial.

SUMMARY

Certain embodiments of the present invention may provide solutions to the problems and needs in the art that have not yet been fully identified, appreciated, or solved by conventional electron guns. For example, some embodiments of the present invention pertain to radial RF electron guns capable of generating an electron beam, in the form of an annular sheet, as one or more beamlets, or both, that can propagate either radially inward, towards the axis of a cylinder, or radially outward from the axis.

In an embodiment, an apparatus includes a first cell defining a first cavity and a plurality of beam tubes. Each beam tube includes at least two segments. At least some of the plurality of segments are connected to the first cell. The apparatus also includes a plurality of beam sources. Each beam source is configured to project an electron beam into a respective beam tube.

In another embodiment, a radial RF electron gun includes a first cell defining a first cavity and a second cell defining a second cavity. The second cell is at least partially surrounded by the first cell. The radial RF electron gun also includes a plurality of beam tubes. Each beam tube includes a plurality of segments and is spaced at an equal distance and angle from one another radially around the first cell and the second cell. The radial RF electron gun further includes a plurality of beam sources. Each beam source is configured to project an electron beam into a respective beam tube. At least some of the plurality of segments connect the first cell to the second cell.

In yet another embodiment, a radial RF electron gun includes a first cell defining a first cavity and a second cell defining a second cavity. The second cell is at least partially surrounded by the first cell. The radial RF electron gun also includes a plurality of beam tubes. Each beam tube includes a plurality of segments. The radial RF electron gun further includes a plurality of beam sources. Each beam source is configured to project an electron beam into a respective beam tube. Additionally, the radial RF electron gun includes a pipe positioned to extend through a center of the radial RF electron gun. At least some of the plurality of segments connect the first cell to the second cell. A portion of the pipe is surrounded by the first cell and the second cell. The pipe is configured to carry material to be irradiated by the radial RF electron gun.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Some embodiments of the present invention pertain to radial RF electron guns capable of generating an electron beam, in the form of an annular sheet, as one or more beamlets, or both, that can propagate either radially inward, towards the axis of a cylinder, or radially outward from the axis. The electron beam may be "pulsed" or "bunched" in some embodiments—e.g., an electron beam including bunches of electrons emitted at the RF frequency, or a harmonic or subharmonic thereof. A beam source capable of generating a radially inwardly propagating electron beam, while perhaps not particularly useful as a source for a higher-energy accelerator, offers potential advantages for materials processing, as the geometry allows irradiation from all sides of an enclosed material flow with a single structure. Other potential applications include, but are not limited to, atmospheric plasma generation, radiation damage testing, and possibly, novel electron lens-type devices for hadron accelerators.

Figure 1:
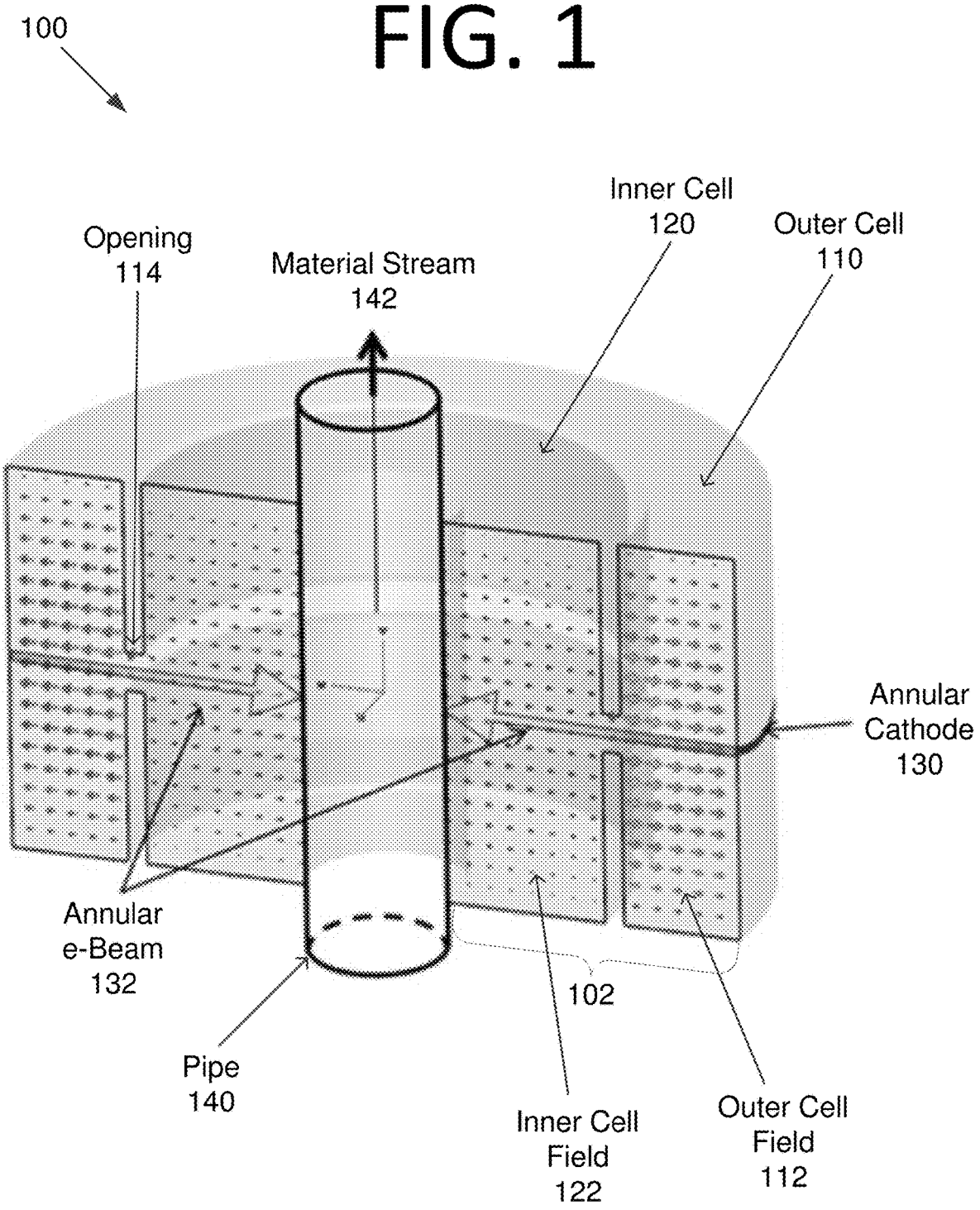
FIG. 1 is a cutaway perspective view illustrating a single annular RF gun system that propagates an electron beam radially inward, according to an embodiment of the present invention.

Los Alamos National Laboratory (LANL) and the Air Force Research Laboratory (AFRL) have developed a concept for a "radial" RF-driven electron beam source, with one or more annular RF cavities delivering a beam towards the axis of the annulus. Such an annular beam source system 100 is shown in FIG. 1. Annular beam source system 100 includes an annular RF gun 102, which includes an outer cell 110 and an inner cell 120. Outer cell 110 and inner cell 120 contain and define hollow cavities under vacuum. Outer cell 110 and inner cell 120 provide additional acceleration for the electrons generated by annular cathode 130, and the shape, size, and number of cells 110, 120 is in accordance with the desired acceleration characteristics, as is the method selected to provide RF power to outer cell 110 and inner cell 120. The small arrows in cells 110, 120 indicate the direction and magnitude of the RF field at the location of the respective arrow. While cells 110, 120 are shown as defining two cavities here, it should be noted that one, three, four, or any other number of cells/cavities may be used without deviating from the scope of the invention. Also, in some embodiments, multiple annular cathodes with multiple respective openings could be included in a single annular RF gun without deviating from the scope of the invention.

Annular cathode 130 is located in the inside of the outer wall of outer cell 110 and has a ring shape. In other words, annular cathode 130 extends along the entire circumference of outer cell 110. Annular cathode 130 generates an annular (i.e. ring-shaped) electron beam (i.e., e-beam) 132 that propagates from annular cathode 130 through an opening 114 between outer cell 110 and inner cell 120, through inner cell 120, and into a pipe 140 containing material to be irradiated. Annular cathode 130 may include or be any variant of several types of electron emitters including, but not limited to, thermionic emitters that are heated to release electrons, photocathode emitters that are illuminated with light to release electrons, and field emitters that are induced to emit electrons via the presence of an electric field such as, but not limited to, outer cavity field 112. Annular cathode 130 may include a single annular strip or discrete elements placed in a ring-like configuration.

Depending upon the electron beam energy, the material to be processed, and other factors, an electron beam "window" (not shown) may be present at the junction between inner cell 120 and pipe 140 to facilitate electron injection from annular cathode 130 into pipe 140. The window, if present, may be physically attached to inner cavity 120, pipe 140, or an alternate intermediate structure deemed to be beneficial for electron transport. Such a window may be similar to window 450 of FIG. 4, for instance.

Preferably, from each arbitrary location of annular cathode 130, annular e-beam 132 would penetrate at least to the center of pipe 140. See FIG. 5C. Pipe 140 houses a flowing material stream 142 (e.g., liquid chemical waste, flue gas or other gaseous emissions, radioactive waste, otherwise toxic waste, and/or any other material to be processed), and is at least partially surrounded by annular cathode system 100. Annular e-beam 130 irradiates material 142, which destroys DNA molecules, ionizes materials in chemical reactions to make them react in ways that they otherwise would not (e.g., destroying dangerous chemicals or driving beneficial chemical reactions), etc. While these examples are nominally specific to treatment of waste of various forms, a similar process of irradiation could be applied to any material for which electron irradiation would prove beneficial and which could be transported in a suitable fashion.

Figure 2:
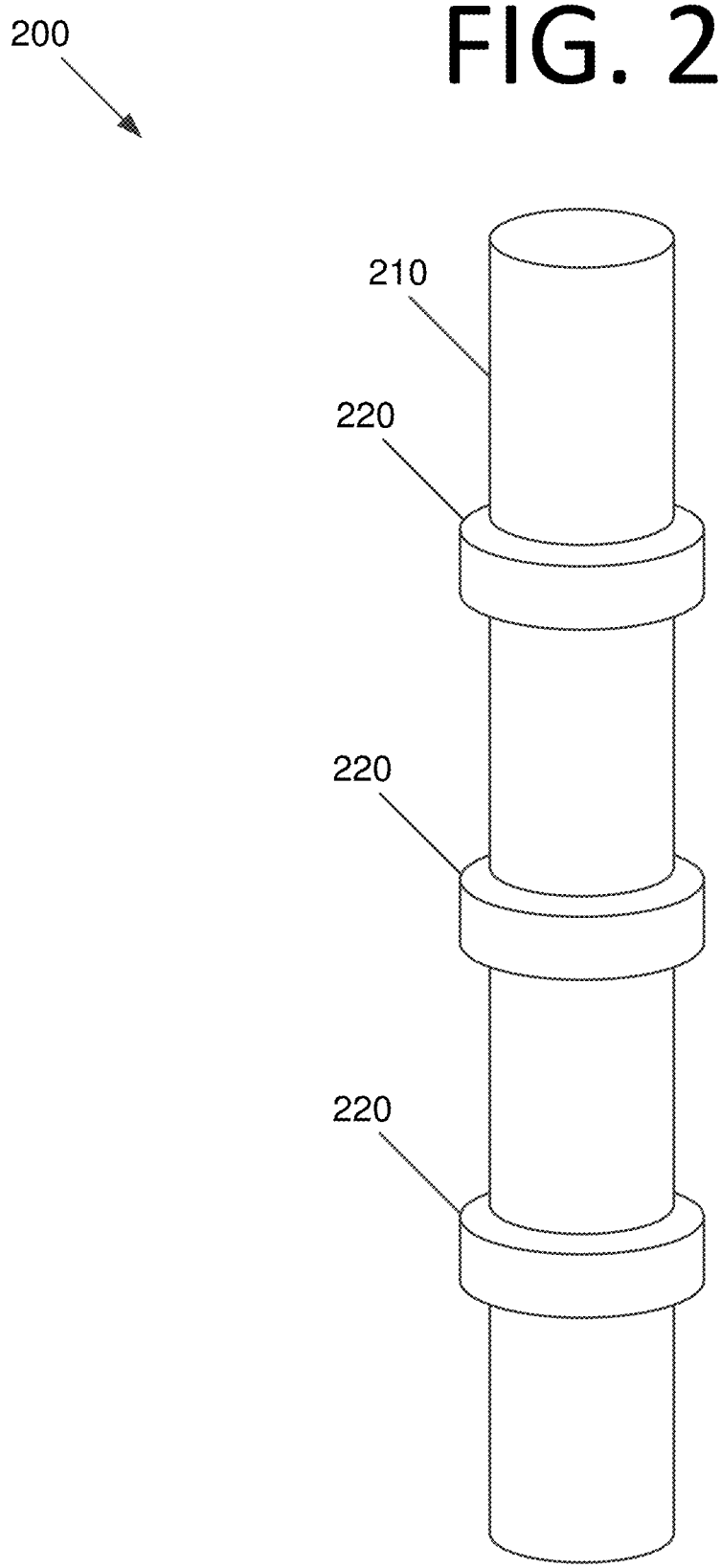
FIG. 2 is an external view illustrating a multiple annular RF gun system that propagates multiple electron beams radially inward, according to an embodiment of the present invention.

In some embodiments, multiple annular cathodes may be used. For instance, in multiple ring annular RF gun system 200 of FIG. 2, a pipe 210 is surrounded by three annular RF guns 220 at different locations, which are clamped to pipe 210. Any number of annular RF guns may be used without deviating from the scope of the invention. Annular RF guns 220 could clamp around pipe 210 at any desired location, and be designed based on the size of pipe 210 (or alternatively, pipe 210 could be designed based on the size of annular RF guns 220). In some embodiments, a single annular RF gun could incorporate multiple rings of cathodes.

It should be noted that the larger the pipe diameter, the greater the kinetic energy that is required for the electron beams(s) for a given material transported within the pipe. Nonetheless, the embodiments of FIGS. 1 and 2 allow the use of a cylindrically symmetric pipe to transport the material to be processed, allow the use of a larger diameter pipe without the need for multiple beam sources at different points along the perimeter of the pipe, and eliminate the need for a beam rastering or spreading system. Indeed, the raster scan required for a pencil beam introduces issues of material flow rates, equivalent beam exposure, etc.

Figure 3:
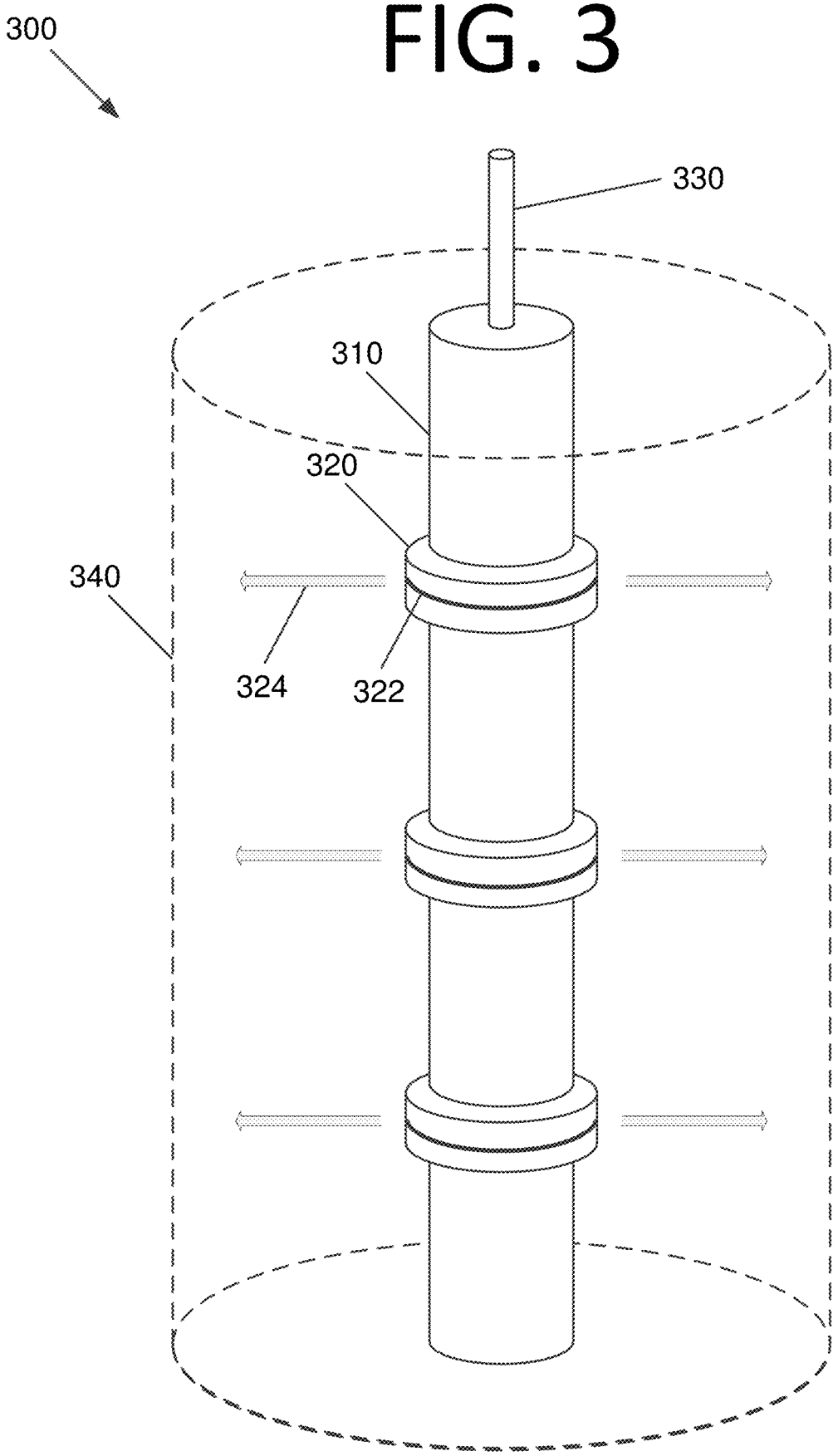
FIG. 3 is a cutaway perspective view illustrating a multiple annular RF gun system that propagates multiple electron beams radially outward, according to an embodiment of the present invention.

In certain embodiments, the direction of the electron beam emission may propagate radially outward rather than radially inward. Such a multiple ring annular RF gun system 300 is shown in FIG. 3. Similar to FIG. 2, multiple ring annular RF gun system 300 includes three annular RF guns 320. However, annular RF guns 320 radiate an annular electron beam 324 outwardly in this embodiment. A hollow housing 310 in the shape of a rod or tube in this embodiment provides attachment points for annular RF guns 320 and a pathway for any desired connectors 330 (e.g., power cables for annular cathodes 320).

In use, a single annular RF gun 320 or multiple ring annular RF guns system 300 may be lowered into a drum 340 containing waste. When powered, annular RF guns 320 irradiate the waste material in which they are immersed. Alternatively, a single ring annular RF gun 320 or multiple ring annular RF gun system 300 could be suspended or affixed within a smokestack or pipe to irradiate liquid or gas passing along the outside thereof.

Figure 4:
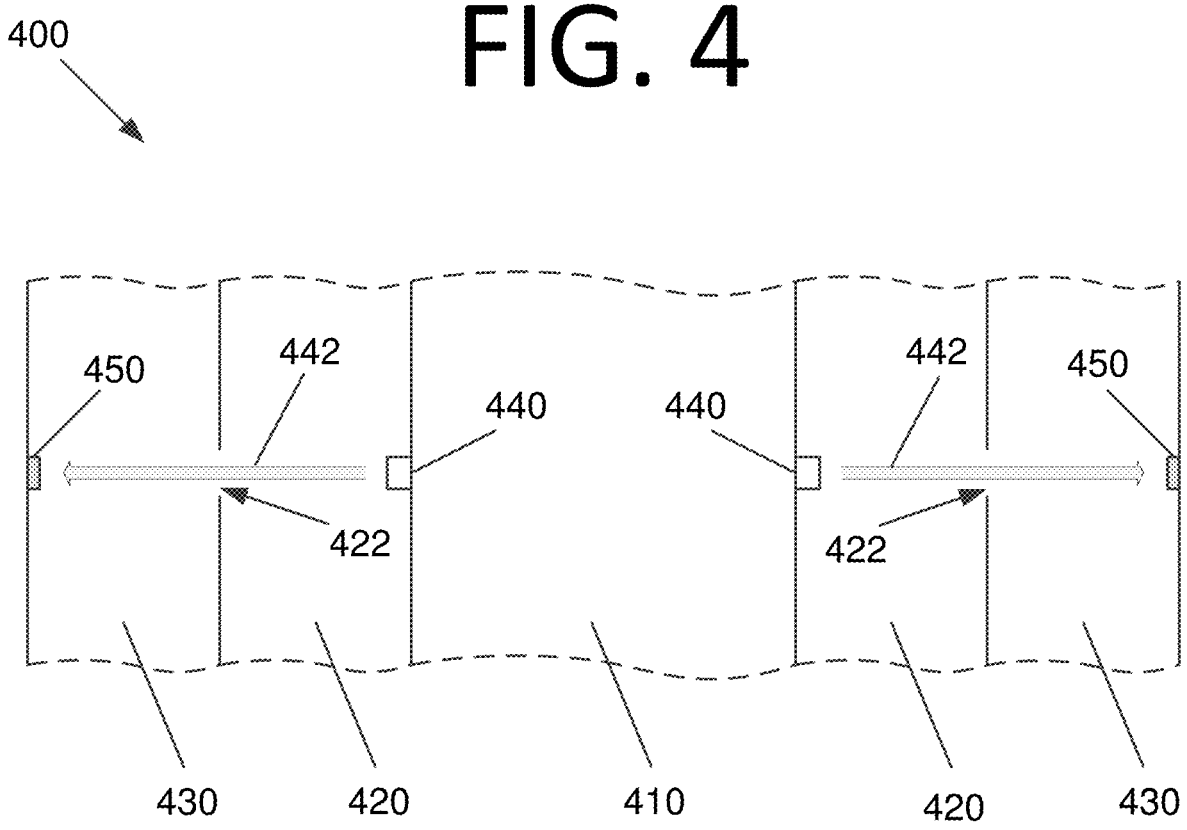
FIG. 4 is a partial side cutaway view illustrating an annular RF gun that propagates an electron beam radially outward, according to an embodiment of the present invention

FIG. 4 is a partial side cutaway view of an annular RF gun 400, according to an embodiment of the present invention. Annular RF gun 400 has a housing 410 that provides space for power cables and connections (not shown). Annular RF gun 400 also has a hollow inner cell 420 and outer cell 430 that are under vacuum and have an opening 422 therebetween. An annular cathode 440 on an inside of the inner wall of inner cell 420 emits an electron beam 442, which propagates from inner cell 420 through opening 422, then through outer cell 430, and out of an annular window 450. Annular window 450 may be constructed from beryllium or any other suitable material, and such windows are commercially available. In some embodiments, multiple annular cathodes with multiple respective openings and windows could be included in a single annular RF gun without deviating from the scope of the invention. Also, any desired number of cells may be used without deviating from the scope of the invention.

Figure 5A:
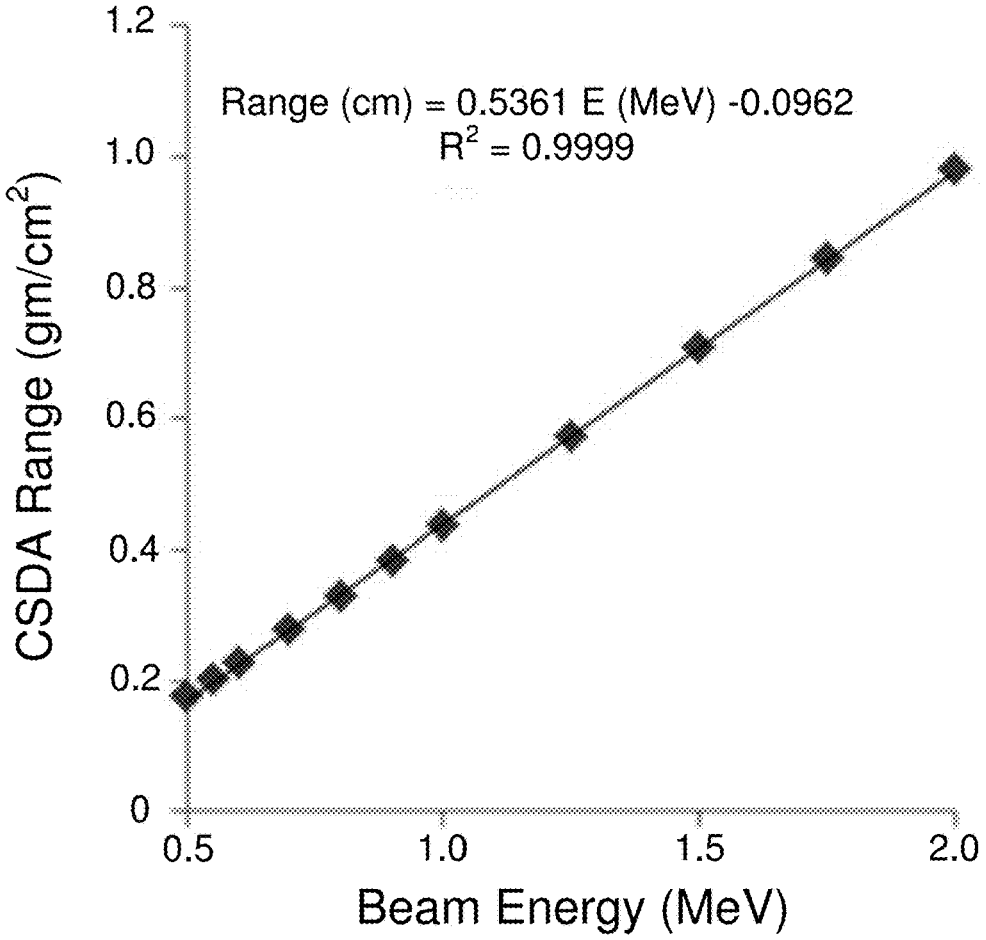
FIG. 5A is a graph illustrating electron range in water as a function of energy over the range of Type 1 and 2 accelerators.
Figure 5B:
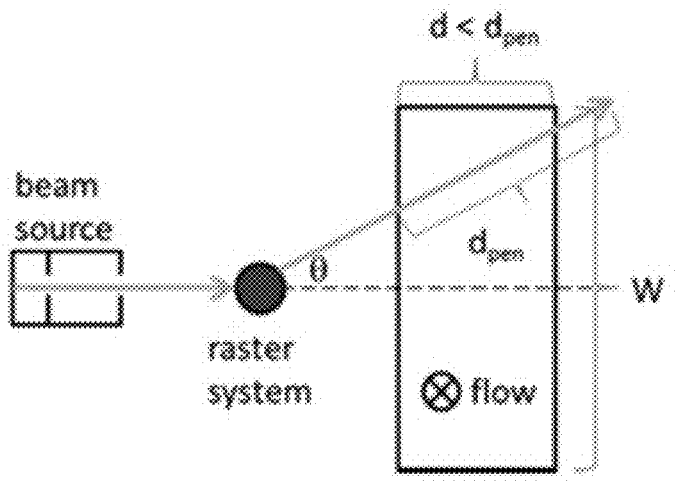
FIG. 5B illustrates a target geometry for a linear beam source.
Figure 5C:
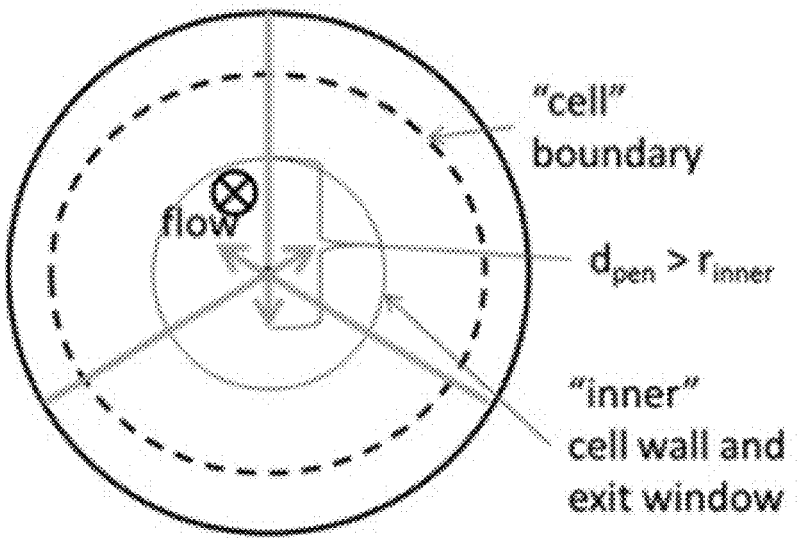
FIG. 5C illustrates a target geometry for a radial beam source, according to an embodiment of the present invention.

FIGS. 5A-C provide comparisons between linear and radial beam sources for waste stream processing. More specifically, FIG. 5A is a graph 500 illustrating electron range in water as a function of energy over the range of Type 1 and 2 accelerators. The continuous-slowing-down approximation (CDSA) is a close approximation of the average path length traveled by a charged particle as it slows to rest. CDSA is obtained by integrating the reciprocal of the total stopping power with respect to energy. FIG. 5B illustrates a target geometry 510 for a linear beam source. FIG. 5C illustrates a target geometry 520 for a radial beam source, according to an embodiment of the present invention. In FIG. 5C, $d_{pen}$ is the beam penetration depth and $r_{inner}$ is the radius of the waste stream pipe.

In summary, a linear beam source requires overpenetration of the waste stream to deliver dose to all portions of the stream, wasting beam power, and waste stream cross-sectional area scales linearly with the beam energy. A radial beam source, in contrast, can be designed such that the entire waste stream can receive a radiation dose while completely absorbing the beam within the stream, and the waste-stream area scales with the square of the beam energy. Thus, a radial (i.e., annular) design has significant advantages over conventional linear designs.

The ionization and radiation dose delivered at the side of the waste stream nearest the source will be higher than the dose delivered at the far side from the source. The degree of reduction will depend upon the density and thickness of the waste stream, as well as the beam energy. However, in order to deliver a non-zero dose to all portions of the waste stream, given a linear beam source, the penetration depth must exceed the waste stream depth, as shown in FIG. 5B.

To reduce the difference in the delivered dose within the waste stream, the stream may be presented to the beam with a large aspect ratio, (e.g., wide and thin as seen from the beam source). However, this imposes additional requirements for beam spreading, rastering or "painting", and may (depending on the nature of the waste stream) impose unacceptable restrictions on flow rates, suspension particulate size, etc. The rastering system may impose requirements on beam quality (e.g., for beam halo control), which may be difficult to meet at the desired beam power levels. The requirement for radiation shielding also increases as the required overpenetration increases.

A radial beam source, such as that illustrated in FIGS. 1-4 and 5C, reduces or eliminates many of these concerns. Referring to FIG. 5C, to deliver dose to all areas of the waste stream, the penetration depth must be greater than the radius of the waste stream, but can be smaller than the diameter. The ratio of penetration depth to waste stream radius can be optimized to increase uniformity of delivered dose, or to minimize beam power given a required minimum dose. Other advantages include, but are not limited to, the ability to maintain a circular cross-section transport of the waste stream, large cavity surface area for input power coupling and cooling, elimination of the need for a rastering system, decreased sensitivity to beam halo issues, simplified shielding, and the ability to deliver the same minimum radiation dose at lower beam power since all beam power can be delivered to the stream (modulo losses occurring at the beam exit window and through the waste stream containment wall, if separate from the window; to the first order, such losses should be comparable between linear and radial beam sources), and no overpenetration is required.

Finally, that in regimes where the beam penetration depth scales linearly with energy (as it does for water with beams in the 0.5 to 2 MeV range), the cross-sectional area of the medium to be processed scales linearly with energy for a linear beam source, but quadratically with energy for a radial beam source. It is also believed that, when dealing with low-density media, it is possible that a radial beam source may be amenable to energy recovery. This increases the overall efficiency of the source.

While a radially propagating electron beam for klystrons has been explored in the past, this does not offer significant operating benefits, such as dramatic increases in efficiency, compared to conventional designs. Similarly, the radial beam source of some embodiments may not have significantly better, or worse, figures of merit compared to linear beam sources in terms of shunt impedance, quality factor, etc. However, the radial beam source may significantly simplify and improve a materials processing system from both materials handling and accelerator operation standpoints.

Preliminary designs have been developed for RF cavities intended to support modes capable of accelerating an electron beam radially using fields generated by the modeling code Computer Simulation Technology (CST) Studio Suite™, as shown in FIG. 1, and using the spiffe time-axial-radial (t-z-r) particle-in-cell (PIC) code. One-dimensional (t-r vs. t-z) analytical particle tracking shows beam energy gain consistent with expectations given the cavity dimensions and gradients assumed, as does spiffe. During this process, it was discovered that a large fraction of the body of knowledge associated with conventional injector design (e.g., first cell gap should be ~¼ of an RF wavelength in length), suitably modified for the radial geometry, proves a good starting point for the design of a radial beam source. It should be noted that although the cavity mode structure resembles a transverse-electric (TE) field mode, this design of an RF-driven beam source does not violate the Panofsky-Wenzel theorem, as the theorem applies to fast (already relativistic) particles passing through a cavity parallel to its axis. Neither condition is satisfied within the radial RF gun.

The propagation of electron beams through media such as water (or aqueous solutions) is a fairly well understood phenomenon, and in the energy range of a Type 1 or 2 accelerator, the average penetration depth $d_{pen}$, ranges from 0.175 to 1 centimeter (cm) and scales approximately linearly with energy, as shown in FIG. 5A. This limits the extent of one dimension of the waste stream, parallel to the beam direction and perpendicular to the direction of material flow, to be at most one penetration depth. In fact, this would result in the minimum delivered dose being approximately zero, so in practice the waste stream must be thinner than the penetration depth, resulting in beam exit from the stream and wasted beam power.

The ability to spread the beam out along the other transverse dimension determines the size of the waste stream in the other transverse dimension (i.e., "W" in FIG. 5B). Depending upon the design of the spreader and the flow pipe, the maximum spread angle may further lower the effective penetration by the cosine of the deflection angle. The product of width times depth provides the area of the flow, and dividing by the volume of material to be processed per day, yields the required flow rate. Increasing the beam energy will increase the penetration depth, and assuming the width remains the same, linearly increases the cross-sectional area of the processing region. For a constant flow speed, a linear increase in the beam energy enables a linear increase in the volume of material to be processed per unit time. For a constant volume of material to be processed per unit time, a higher beam energy linearly decreases the required flow rate.

Referring again to FIG. 5B, increasing W without increasing 8 is possible, but the larger the width desired, the more complex the spreader and the more important halo management becomes. Doing so, however, will not change the fundamentally linear scaling of accessible processing region area with beam energy. In contrast, an inwardly propagating radial beam source does not require a spreader, as the beam is naturally directed inward from the perimeter of the pipe. The penetration depth sets the maximum diameter of the pipe, as indicated in FIG. 5C. As the pipe radius can be increased linearly with beam energy, the cross-section (and thus volume) of material processed per unit time for a constant flow speed would increase quadratically, not linearly, with the beam energy, given a constant flow rate. Also, given an approximately linear energy loss with penetration depth, it is hypothesized that a radial beam source would have a fairly uniform energy deposition since, in the absence of absorption and scattering, beam power density would scale inversely with radius.

Accordingly, for waste stream processing, a radial beam source can deliver a given minimum dose more efficiently and uniformly, scales more effectively to larger flow volumes, has a simpler beam transport system as no spreader is required, and may not require cross-sectional changes to the material handling system (e.g., from a round to a rectangular pipe). Indeed, some embodiments provide a "clamp-on" RF-based beam source to facilitate processing of waste streams with minimal retrofitting of existing facilities.

To perform an initial check of these assumptions, the shower code was used to model both "pencil" and "radial" beams impinging upon a cylinder of water. In both cases, the cylinder is 1.5 cm in diameter and the electron beam kinetic energy is 1.75 MeV. A low-energy cross-section data file, originally prepared for low-beam-voltage radiation therapy simulations, was used to allow particle tracking down to kinetic energies of 4 keV. The results are shown in contour maps 600, 610 of FIGS. 6A and 6B, respectively. The black grid lines are artifacts of the plotting program. Shower code and the EGS4 code upon which it is based are not ideal tools for this type of modeling, and this relatively simple model does not include features such as exit windows and pipe walls. Nevertheless, it serves to illustrate the potential advantage of a radial beam source over conventional designs.

Figure 6A:
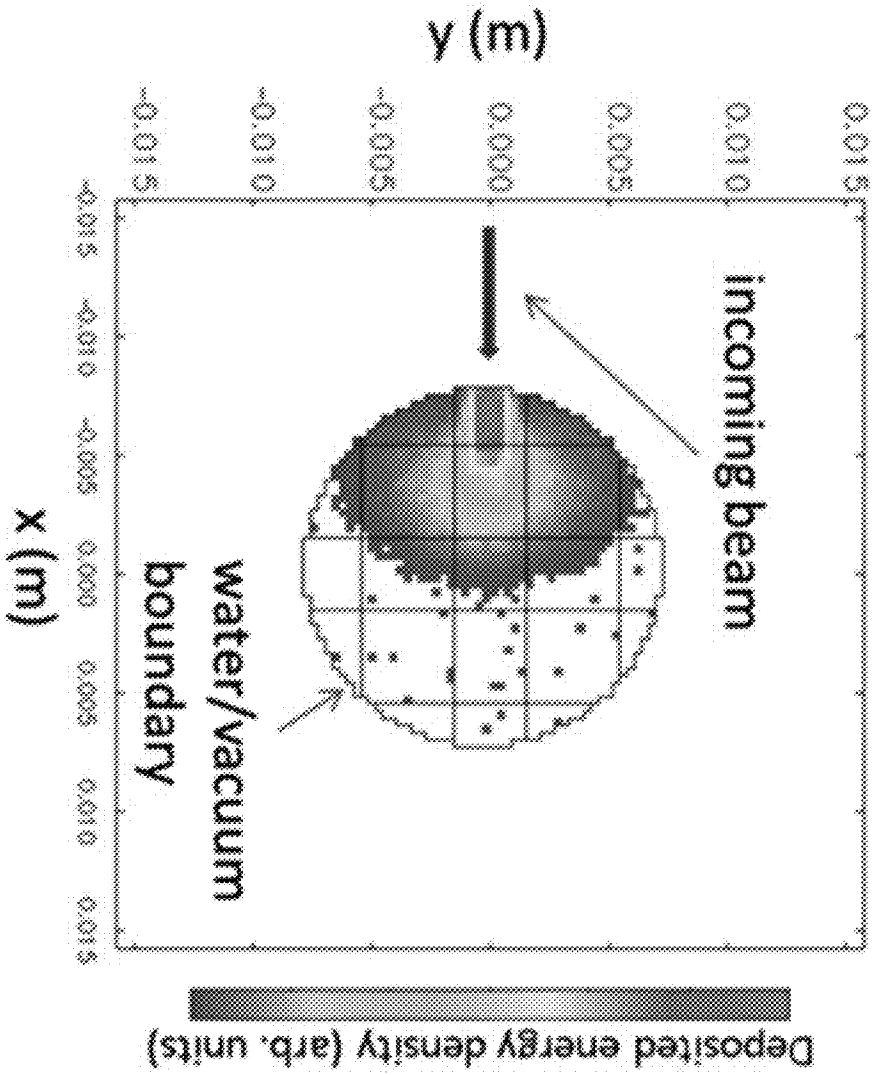
FIG. 6A is a contour map illustrating deposited energy density within a cylinder of water 1.5 cm in diameter being impacted by 1.75 MeV (kinetic) electron beams in a pencil configuration.
Figure 6B:
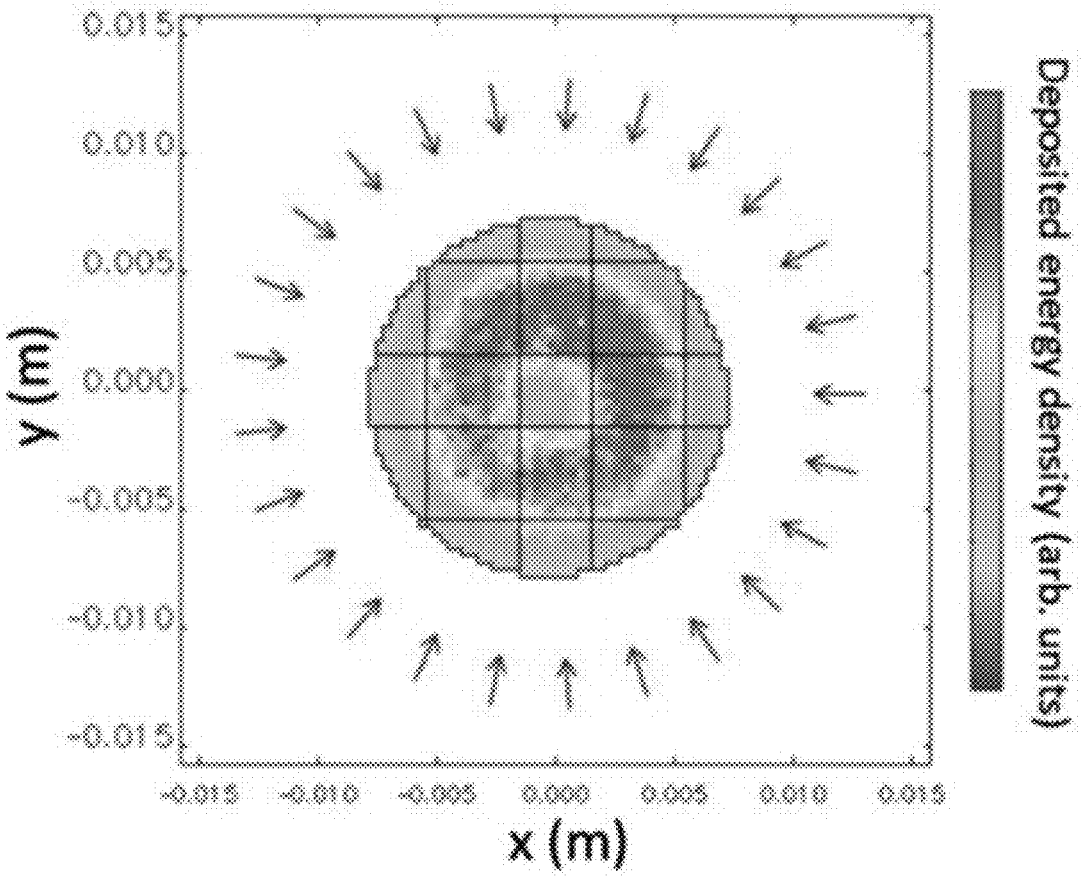
FIG. 6B is a contour map illustrating deposited energy density within a cylinder of water 1.5 cm in diameter being impacted by 1.75 MeV (kinetic) electron beams in a radial configuration, according to an embodiment of the present invention.

Contour map 600 of FIG. 6A shows the relative dose density delivered by a pencil beam. The region where dose is delivered extends approximately halfway through the pipe, as would be expected from FIG. 5A, with a very nonuniform distribution of dose within the pipe. More than half of the pipe receives no dose at all. Contour map 610 of FIG. 6B, assuming a radial beam source, shows that the dosed region extends throughout the pipe, dropping somewhat in the middle (again, as expected), but overall, is much more uniform. Comparing FIG. 6B with FIG. 6A, the "hot donut" appears at roughly the depth where scattering effects become highly noticeable and the pencil beam begins to "plume." In fairness, it should be noted that the geometry was not optimized for the benefit of a linear beam source (e.g., assuming a spreader or an alternate pipe cross-section). However, such optimizations (and, by extension, associated physical hardware) are not necessary for a radial beam source.

The overall approach towards the modeling and simulation should follow the general procedure for any new RF cavity-based beam source: initial cavity design and beam transport modeling, followed by optimization of the structure and assumed operating conditions to improve specific figures-of-merit. In this particular case, the figures of merit may include cavity r/Q and beam energy and energy spread vs. field gradient and cavity parameters (e.g., annular cell "lengths"). Initial parameter sensitivity estimates may be obtained from the optimizations.

In practice, superconducting structures may be used to provide the highest possible beam power-to-RF power ratio. In some embodiments, a thermionic cathode may be used as the electron source. As it would for a linear beam source, this significantly simplifies the operating and maintenance requirements compared to a photocathode, while adding some complexity in terms of electron back-bombardment and integration into a notionally superconducting cavity. One way to deal with the latter concern is to use a DC-based "pre-injector" operating at relatively low voltage to allow more separation between the thermionic cathode and superconducting surfaces. It should be noted that such a design has been explored in practice for a hybrid DC/superconducting RF (SRF) beam source. The specific choice of cathode would, in any case, be dependent upon the design goals and performance requirements for a specific application of a radial RF gun, and any specific cathode choice would not deviate from the scope of the invention.

For a prototype design, an operating frequency of 350 MHz was selected since MW-class continuous wave (CW) klystrons at this frequency are commercially available and in service in storage rings.

Cavity Design

The basic form of the cavity for this prototype is a half-wavelength coaxial resonator with length $L_{cav}$ and inner (outer) radii $r_{i(o)}$. The mode of interest has electric fields $E_z=E_\varphi=0$, and $$E_r(r, z, t) = \frac{E_n}{r}\cos\left(\frac{\pi}{L_{cav}}z\right)\cos(2\pi f_0 t + \varphi) \quad (1)$$

for $|z|<L_{cav}/2$ and $r_i \le r \le r_o$, $E_n$ is the magnitude of the field at unit radius, $f_0=c/2L_{cav}$ is the resonant frequency, and $\varphi$ is a constant phase offset.

The notional cavity shown in FIG. 1 is a 2-cell coupled cavity coaxial resonator, which is the radial RF gun equivalent of a 1.6-cell photoinjector cavity. In practice, while it was found to be possible to generate such a coupled cavity design, as in the 1.6-cell photoinjector cavity, the field balance between the cells is quite sensitive to the details of the geometry. Therefore, some embodiments focus on the use of single cavities or multiple cavities that are independently powered and phased (see, e.g., FIGS. 7A and 7B).

The design shown in FIG. 1 includes an annular cathode 130. While ideal in concept, such a design may not be practical. Rather, N cathodes may be used that are spaced at 360/N degrees around the equator of the cavity as the beam source. For N≥6, a reasonable approximation of an annular beam should be obtained by the time the beams reach the target at the axis of the cavity.

As the eventual goal of some embodiments is the design of an industrial beam source, thermionic cathodes may be used rather than photocathodes. Given that the RF cavities are to be superconducting in some embodiments, however, both thermal isolation and short emission periods (relative to the RF period) may be desired to minimize "tails" and beam loss inside the cavity.

To that end, a conceptual design for a relatively low-voltage (~25 kV) DC gun based around a gridded cathode has been developed. If the total beam current is to be on the order of 1 A, then each cathode must supply on the order of 0.1-0.2 A. At 25 kV, this corresponds to an electron gun power on the order of 5 kW, which is well within the range of commercial power supplies.

Per-cathode beam currents of 0.1-0.2 A correspond to bunch charges of 0.3-0.6 nanoCoulombs (nC). Bunches shorter than about 40° relative to the cavity RF period may be desired to help control energy spread and differential focusing, corresponding at 350 MHz to 300 picoseconds (ps), or peak beam currents of around 1-2 A. Operating at this voltage and peak current allows the beam to be drifted from the gun through a reasonable distance to the cavity entrance, allowing for thermal isolation and access to the cathode from outside of a cryogenic enclosure for easier maintenance.

Figure 7A:
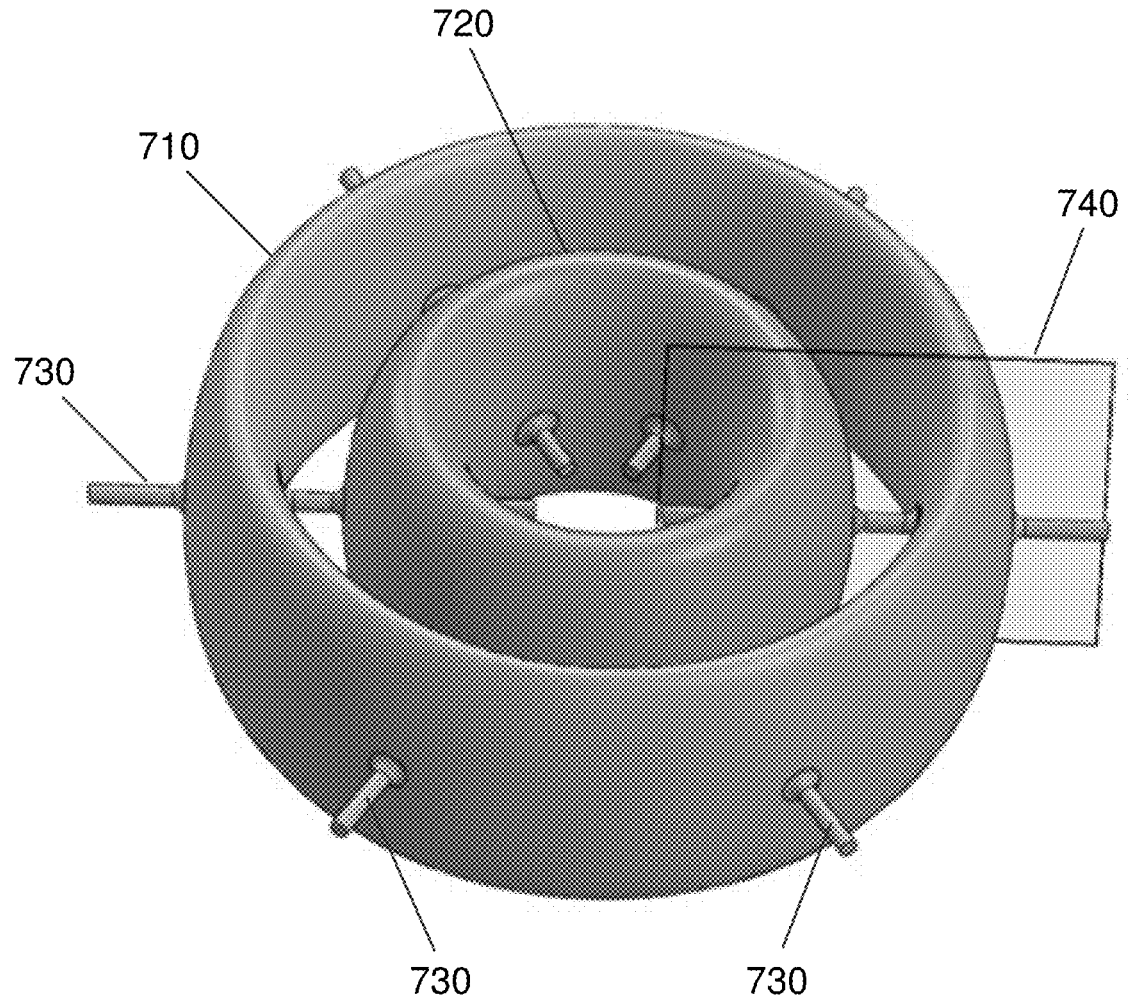
FIG. 7A is a perspective view illustrating a two-cavity radial RF gun with independently powered cavities, where the cavities can be independently driven to a desired RF field strength and the relative phase of the RF fields in the two cavities can be adjusted arbitrarily, according to an embodiment of the present invention.
Figure 7B:
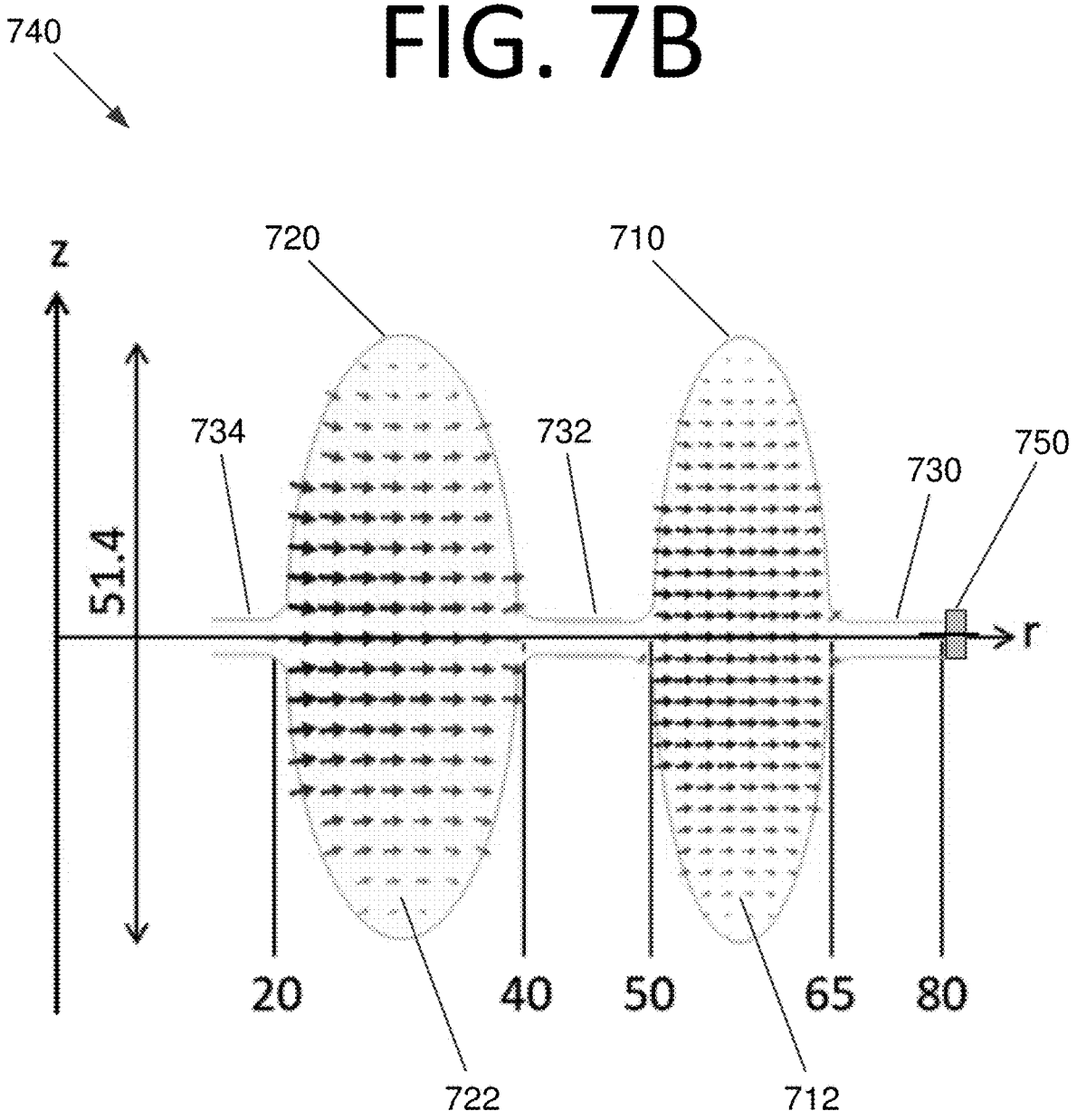
FIG. 7B is a cross-sectional view illustrating a portion of the two-cavity radial RF gun of FIG. 7A, according to an embodiment of the present invention.

An independently powered two-cell (i.e., two-cavity) radial RF gun 700 is shown in FIGS. 7A and 7B. However, any desired number of cavities may be used without deviating from the scope of the invention. In this design, elliptical toroids were chosen for outer cell 710 defining an internal cavity 712 and an inner cell 720 defining an internal cavity 722, which are similar in cross-section to linear accelerator superconducting cavities. A pipe, such as pipe 140 of FIG. 1, may be located within the "donut hole" of inner cell 720 in some embodiments.

Six beam tubes 730 provide electron beams in this embodiment. However, cells 710, 720 could readily support up to at least 12-15 ports in this embodiment. Adding more ports trades off a lower per-cathode beam current versus greater heat leakage from outside the cryostat. However, any desired number of beam tubes may be used without deviating from the scope of the invention. The end of each beam tube (segment 730) extending outside of outer cell 710 is defined herein as the "outer end" and the end of each beam tube (segment 734) extending inside of inner cell 720 is defined as the "inner end."

Cross-section 740 of FIG. 7B shows arrows depicting the direction and relative magnitude of the RF fields within outer cavity 712 and inner cavity 722. The depicted dimensions are in units of centimeters. Cells 710, 720 have heights of 51.4 cm in this embodiment. This height was selected to allow cells 710, 720 to resonate at 350 MHz, but could be adjusted to obtain resonance at any desired frequency without deviating from the scope of the invention.

Inner cell 720 is 20 cm long and is positioned such that its inner wall is 20 cm from the center of radial RF gun 700 and its outer wall is 40 cm from radial RF gun 700. Outer cell 710 is 15 cm long and is positioned such that its inner wall is 50 cm from the center of radial RF gun 700 and its outer wall is 65 cm from radial RF gun 700. Similar to the cell height, the inner and outer wall positions of cells 710, 720 may be determined based on the desired resonant frequency and/or other considerations such as, but not limited to, the desired electron energy gain. In this view, an electron beam source 750 is shown at r=80 cm.

The lengths of outer cell 710 and inner cell 720 were individually optimized to have their fundamental modes resonant at 350 MHz in this embodiment. The cavity radial separation in cavities 712, 722 is shown as 10 cm. However, this separation could be increased to accommodate a small inter-cavity solenoid, or to increase cavity-to-cavity RF isolation.

Annular cathode 130 is sufficient as an electron source in FIG. 1 since the cell cavities would provide an electric field to extract and accelerate the electrons from the surface of annular cathode 130. However, in FIG. 7B, the electron beam is generated outside of outer cavity 712 and inner cavity 722. Therefore, a separate beam source (e.g., DC Pierce-like electron guns, which are further described below) is needed to apply the electric field to extract and accelerate the electrons produced from the cathode. Thus, rather than using a cathode alone, electron beam source 750 is used. In practice, beam sources would be located at each beam tube 730 in FIG. 7A. Beam source 750 is only shown in FIG. 7B to reduce clutter, and is enlarged for clarity.

It should be noted that 732, 734 are segments of beam tube 730, which does not extend into toroidal cavities 712, 722. The purpose of segments 730, 732, 734 is to provide a path for the beam to transit into and out of cavities 712, 722. It should also be noted that with an even number of beam tubes that are aligned, one beam source from one beam tube could fire into the aligned beam tube on the other side if there were no material flowing down the center. Whether the beam entering the "other side" is accelerated further or decelerated would depend on the operating frequency and the diameter of the inner cavity. If the beam is decelerated, its kinetic energy would be reduced and converted to stored energy in the RF field, which could then be used to accelerate newly-emitted electrons. This process is known as "energy recovery."

It should also be noted that in some embodiments, the beam source could be on the opposite side of the beam tube from what is depicted in FIGS. 7A and 7B. In that case, cell 710 would be closer to half a wavelength across and cell 720 would be closer to ¼ wavelength across if the cathode were located at the end of segment 734 and directed outward. For a design that could handle a cathode in either location, both cells 710, 720 could be made to be about ¼ of a wavelength wide (e.g., the depicted width of cell 710). However, any desired cell widths, cell heights, and/or beam source placements may be used without deviating from the scope of the invention.

In certain embodiments, an odd number of beam tubes are used to ensure that they are not aligned with an opposite beam tube. That way, each beam tube "faces" a blank wall on the far side of the central pipe. That arrangement may assist with both beam diagnostics and radiation shielding.

It should be noted that practical implementations may include additional undepicted components. For instance, a cryostat enclosure for liquid helium, vacuum insulation, an outer shell, etc., may be included. Superconducting embodiments may require such components. One of ordinary skill in the art, however, will readily appreciate what other components may be included in a practical design.

Figure 8:
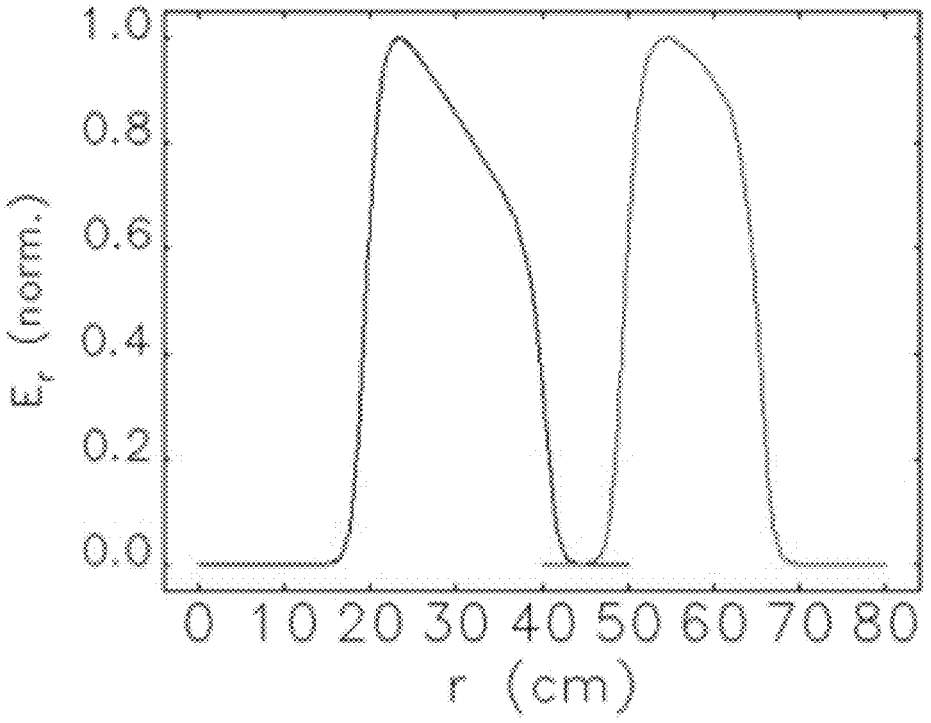
FIG. 8 is a graph illustrating the radial field as a function of position along a beam tube for inner (left) and outer (right) cavities, normalized to the peak field along the beam tube axis, according to an embodiment of the present invention.

FIG. 8 is a graph 800 illustrating the radial field as a function of position along the beam tube for inner (left) and outer (right) cavities, normalized to the peak field along the beam tube axis, according to an embodiment of the present invention. The radial dependence of $E_r$ is clearly visible in FIG. 5.

Electron Source and Initial Transport

The initial source design of FIGS. 7A and 7B is based around the use of a Pierce-like 25-kV DC gun plus a small solenoid to aid transport prior to beam injection into outer cavity 722. The gun is described as "Pierce-like" in this embodiment because the 50° angle used here is not the standard Pierce angle, which is 67.5°. However, any suitable angle may be used without deviating from the scope of the invention.

The gun, simulated using Poisson, has a cathode/anode cone angle of 50° (measured from the axis), a 1 cm accelerating gap, and a 0.56 cm radius gridded cathode 750 located at r=80 cm in this embodiment. The solenoid is 2 cm long, and centered at r=72.5 cm. For comparison, commercial products, such as the Model HWEG-1228 e-gun from HeatWave Labs™, exhibit comparable performance in terms of duty factor, voltage, and perveance.

Beam Dynamics

The General Particle Tracer (GPT) code was used to perform beam dynamics modeling from the cathode grid at r=80 cm to r=0 cm using 300 pC bunches, 300 ps emission times, and a 25-kV DC gun voltage. This corresponds to a per-gun peak current of 1 A and an average current of 0.105 A. The gun solenoid had a peak field of 225 gauss. The on-axis field at r=65 cm (boundary of the outer cavity) was approximately 10 gauss. The peak on-axis fields in outer and inner cavities 712, 722 were 4.5 MV/m and 4.8 MV/m, respectively, and were phased for maximum beam energy gain.

The results shown were generated by tracking 50 k particles using the 3D space charge routine of GPT and the fields calculated with CST and Poisson for the cavities and DC gun, respectively. The GPT bzsolenoid element was used to approximate the gun solenoid. Simulations with 0.6 nC bunches also show acceptable transport.

Figure 9A:
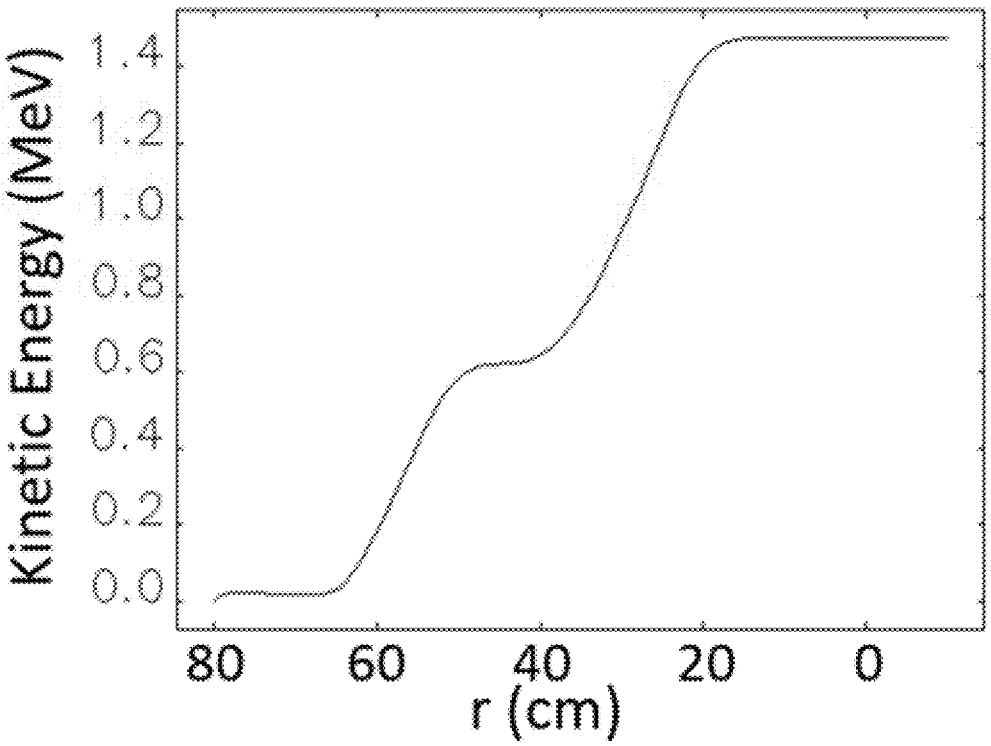
FIG. 9A is a graph illustrating beam energy as a function of radial position, according to an embodiment of the present invention.
Figure 9B:
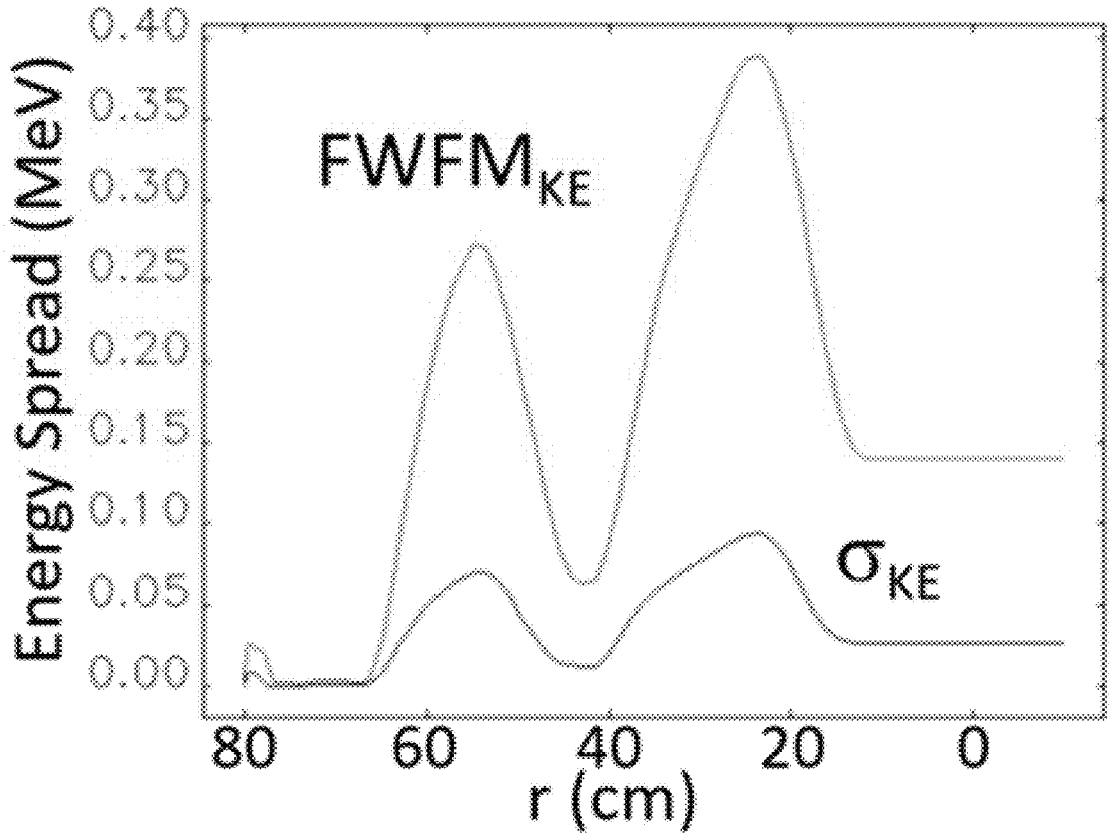
FIG. 9B is a graph illustrating root mean square (RMS) (bottom) and full-width maximum (FWFM) (top) beam energy spread as functions of radial position, according to an embodiment of the present invention.
Figure 10:
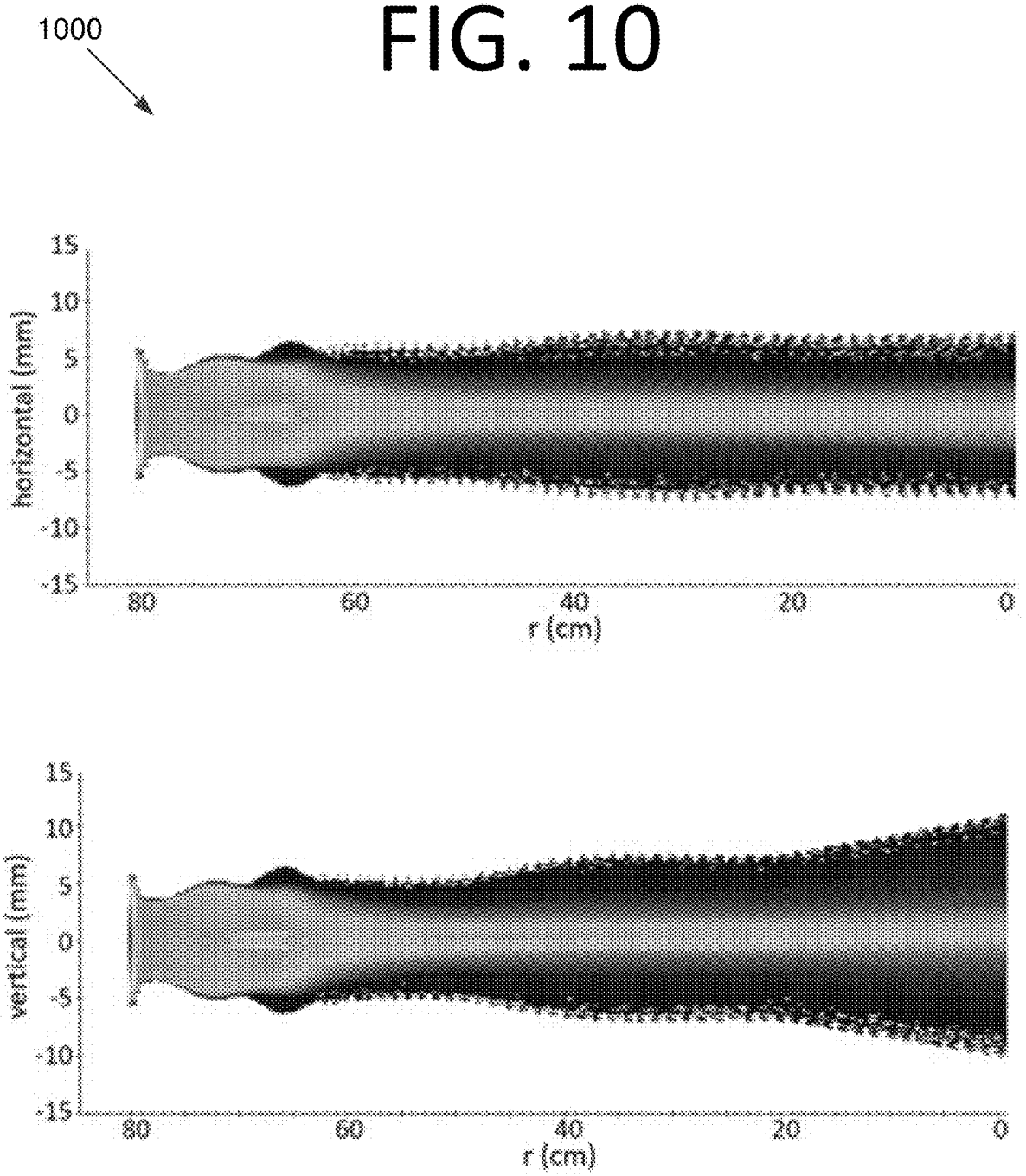
FIG. 10 illustrates Beam envelope in "horizontal" (top) and "vertical" (bottom) local planes as a function of radial position, according to an embodiment of the present invention. "Scalloping" is from histogrammed timestep output.

In graphs 900, 910, and 1000 of FIGS. 9A, 9B, and 10, respectively, the beam is propagating from left to right and properties are plotted versus the radial coordinate axis in FIG. 7B. FIGS. 9A and 9B show the beam energy and energy spread as a function of radial position. The beam envelope is plotted in FIG. 10 using a local Cartesian coordinate system aligned with one beam tube.

In both the horizontal (perpendicular to the z-r plane in FIG. 7B) and vertical (parallel to the z axis in FIG. 7B) local directions, the beam core is well confined. The full beam radius does not exceed the nominal beam pipe radius of 1.5 cm. The inner cavity ends at r=20 cm so, if desired or required, an additional solenoid could be placed before the exit window to spread the beam for a more uniform dose delivery.

This 2-cell design can readily meet the requirements of either a Type 1 or Type 2 source from Table 1. It appears likely that a 1-cell design could also meet the Type 1 requirements. Both are contemplated within the scope of embodiments of the present invention. Such embodiments may be employed for sterilization, flue gas and waste-water treatment, and/or any other suitable application without deviating from the scope of the invention.

Figure 11:
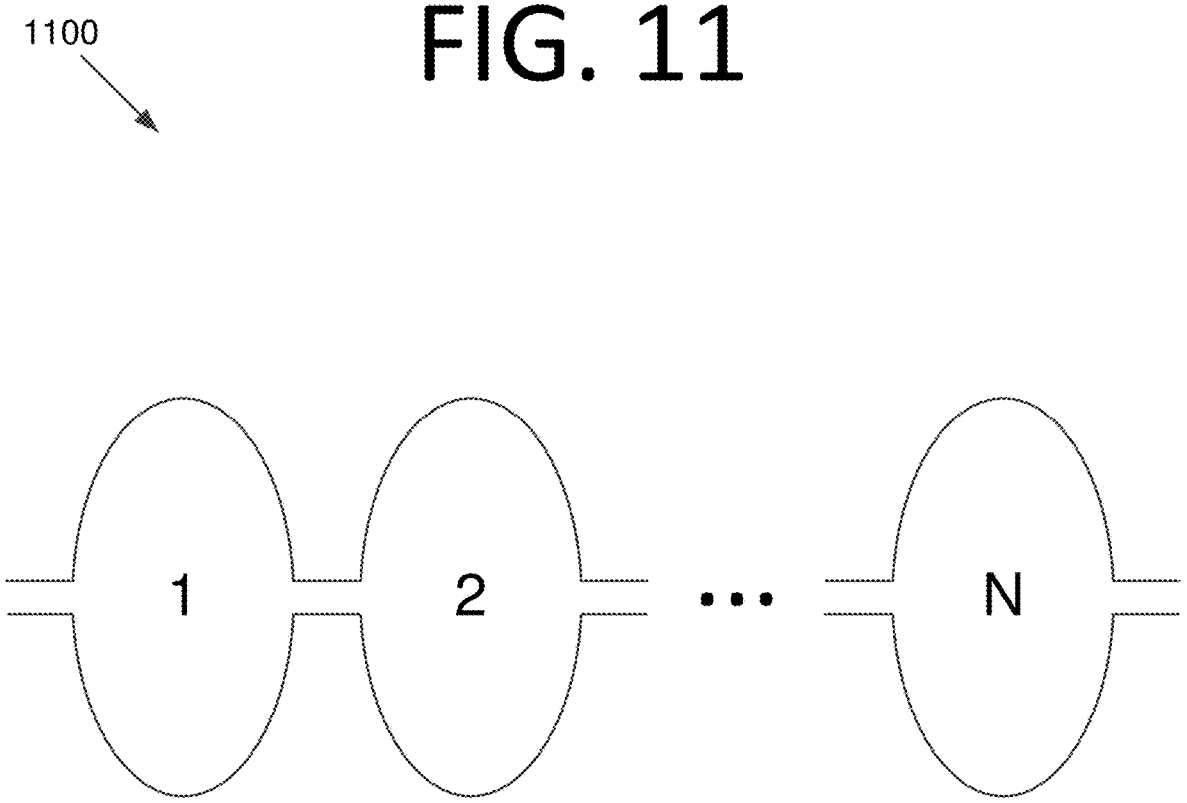
FIG. 11 is a cross-sectional view illustrating a portion of a multi-cavity radial RF gun, according to an embodiment of the present invention.

As noted above with respect to FIGS. 7A and 7B, and also encompassed within the scope thereof, any desired number of cavities may be used without deviating from the scope of the invention. FIG. 11 is a cross-sectional view illustrating a portion of a multi-cavity radial RF gun 1100 with an arbitrary number of cavities, according to an embodiment of the present invention. Multi-cavity RF gun 1100 includes N cavities in this embodiment. While shown as having the same dimensions for illustration purposes, one cavity, a subset of between 1 and N cavities, or all cavities may have different dimensions from one another without deviating from the scope of the invention. In certain embodiments, only a single cavity (e.g. cavity 1) is used.

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. An apparatus, comprising:

a first cell defining a first cavity;

a second cell defining a second cavity, the second cell at least partially surrounded by the first cell;

a plurality of beam tubes, each beam tube comprising at least two segments, at least some of the plurality of segments connected to the first cell; and a plurality of beam sources, each beam source configured to project an electron beam into a respective beam tube, wherein a subset of the plurality of segments connect the first cell to the second cell.

2. The apparatus of claim 1, wherein the first cell and the second cell resonate at a same radio frequency (RF) wavelength, the first cell resonates at half of the RF wavelength and the second cell resonates at one quarter of the RF wavelength, or the first cell and the second cell both resonate at one quarter of the RF wavelength.

3. The apparatus of claim 1, further comprising:

at least one additional cell defining at least one additional respective cavity, the at least one additional cell at least partially surrounded by the second cell, wherein a subset of the plurality of segments connect each additional cell to at least one adjacent cell.

4. The apparatus of claim 1, wherein the plurality of beam tubes are spaced at an equal distance and angle from one another radially around the first cell.

5. The apparatus of claim 1, wherein the first cell is an elliptical toroid in shape.

6. The apparatus of claim 1, wherein dimensions of the first cell are selected so as to cause the first cell to resonate at a predetermined radio frequency (RF) wavelength, selected for a desired electron energy gain, or both.

7. The apparatus of claim 1, further comprising:

a pipe positioned to extend through a center of the apparatus, wherein a portion of the pipe is surrounded by the first cell, and the pipe is configured to carry material to be irradiated by the apparatus.

8. The apparatus of claim 1, wherein the plurality of beam sources are located at one end of the beam tubes.

9. The apparatus of claim 8, wherein at least one of the plurality of beam sources is located on an inner end or an outer end of its respective beam tube.

10. A radial radio frequency (RF) electron gun, comprising:

a first cell defining a first cavity;

a second cell defining a second cavity, the second cell at least partially surrounded by the first cell;

a plurality of beam tubes, each beam tube comprising a plurality of segments and spaced at an equal distance and angle from one another radially around the first cell and the second cell; and a plurality of beam sources, each beam source configured to project an electron beam into a respective beam tube, wherein at least some of the plurality of segments connect the first cell to the second cell.

11. The radial RF electron gun of claim 10, wherein the first cell and the second cell are elliptical toroids in shape.

12. The radial RF electron gun of claim 10, further comprising:

a pipe positioned to extend through a center of the radial RF electron gun, wherein a portion of the pipe is surrounded by the first cell and the second cell, and the pipe is configured to carry material to be irradiated by the radial RF electron gun.

13. The radial RF electron gun of claim 10, wherein the first cell and the second cell resonate at a same RF wavelength, the first cell resonates at half of the RF wavelength and the second cell resonates at one quarter of the RF wavelength, or the first cell and the second cell both resonate at one quarter of the RF wavelength.

14. The radial RF electron gun of claim 10, further comprising:

at least one additional cell defining at least one additional respective cavity, the at least one additional cell at least partially surrounded by the first cell and the second cell, wherein a subset of the plurality of segments connect each additional cell to at least one adjacent cell.

15. The radial RF electron gun of claim 10, wherein the plurality of beam tubes are spaced at an equal distance and angle from one another radially around the first cell and the second cell.

16. A radial radio frequency (RF) electron gun, comprising:

a first cell defining a first cavity;

a second cell defining a second cavity, the second cell at least partially surrounded by the first cell;

a plurality of beam tubes, each beam tube comprising a plurality of segments;

a plurality of beam sources, each beam source configured to project an electron beam into a respective beam tube; and a pipe positioned to extend through a center of the radial RF electron gun, wherein at least some of the plurality of segments connect the first cell to the second cell, a portion of the pipe is surrounded by the first cell and the second cell, and the pipe is configured to carry material to be irradiated by the radial RF electron gun.

17. The radial RF electron gun of claim 16, wherein the first cell and the second cell are elliptical toroids in shape.

18. The radial RF electron gun of claim 17, wherein the first cell and the second cell resonate at a same RF wavelength, the first cell resonates at half of the RF wavelength and the second cell resonates at one quarter of the RF wavelength, or the first cell and the second cell both resonate at one quarter of the RF wavelength.

19. The radial RF electron gun of claim 16, further comprising:

at least one additional cell defining at least one additional respective cavity, the at least one additional cell at least partially surrounded by the first cell and the second cell, wherein a subset of the plurality of segments connect each additional cell to at least one adjacent cell.

* * * * *